United States Patent [19]

Cantrell et al.

[11] Patent Number: 4,715,596

[45] Date of Patent: Dec. 29, 1987

[54] PAPERBOARD SHEET FEEDER

[75] Inventors: Larry K. Cantrell, Spartanburg; Edwin J. Smith, Duncan, both of S.C.

[73] Assignee: Grant Machinery Inc., Inman, S.C.

[21] Appl. No.: 855,117

[22] Filed: Apr. 23, 1986

[51] Int. Cl.[4] ..... B65H 3/06

[52] U.S. Cl. ..... 271/116; 271/132; 74/89.21; 198/783

[58] Field of Search ..... 271/112, 114, 116, 131, 271/132; 74/89.2, 89.21; 198/859, 789, 790, 783

[56] References Cited

U.S. PATENT DOCUMENTS

| | | | |
|---|---|---|---|
| 407,985 | 7/1889 | Woodward . | |
| 3,047,290 | 7/1962 | Thomsen | 271/116 |
| 3,118,321 | 1/1964 | Rinke | 74/89.21 |
| 3,528,304 | 9/1970 | Hopkins | 74/89.21 |
| 4,418,904 | 12/1983 | Fujimoto | 271/116 |
| 4,614,335 | 9/1986 | Sardella | 271/112 |

*Primary Examiner*—Joseph J. Rolla
*Assistant Examiner*—Kenneth Noland
*Attorney, Agent, or Firm*—Price, Heneveld, Cooper, DeWitt & Litton

[57] ABSTRACT

A paperboard sheet feeder for feeding paperboard blanks to the feed rolls of processing equipment includes a support table and a pair of roller assemblies mounted on the support table. A drive includes gears connected to the roller assemblies through one-way clutches. A drive belt has ends secured to a slide block. The belt engages the gears. The slide block is mounted on guide bars for reciprocating movement. The drive belt, gears and one-way clutches convert reciprocating movement of the slide block into rotary movement of the roller assemblies. A source of vacuum communicates with the support table to draw a paperboard sheet into contact with the roller assemblies.

20 Claims, 4 Drawing Figures

PAPERBOARD SHEET FEEDER

BACKGROUND OF THE INVENTION

The present invention relates to paperboard processing equipment and more particularly to an apparatus for feeding paperboard sheets to printers, cutters, slotters, gluers and the like.

Various types of processing equipment are used in the manufacture of paperboard packaging, including printers, cutters, slitters and gluers. The equipment is used to manufacture a wide variety of boxes and special packaging from sheets of paperboard. Generally, individual sheets of paperboard are fed into the processing equipment manually or by automatic sheet feeders.

Heretofore, various sheet feeders have been proposed. Typically, these feed individual sheets from a stack to the feed rolls of the processing equipment. Problems experienced with prior proposals include excessive wear, complexity and difficulties with setup. It is important to minimize maintenance downtime in order to maintain production rates.

An example of one prior approach is found in U.S. Pat. No. 4,045,015 entitled ROTARY FEEDER FOR PAPERBOARD BLANKS and issued on Aug. 30, 1977, to Sardella. The rotary feeder disclosed in this patent includes a plurality of configured feed wheels. Each wheel has an active portion and a relieved portion. A transmission brings the active portion of the feed wheels into contact with the underside of a sheet of paperboard. The sheet is accelerated to match the speed of the feed rolls of the processing equipment. As the sheet is pulled into the feed roll, the wheels move out of contact with the paperboard sheet. The transmission must transmit rotary input motion so that the feed wheels are initially accelerated, then decelerated and then held stationary.

Another example of a sheet feeder is found in U.S. Pat. No. 4,494,745 entitled FEEDING APPARATUS FOR PAPERBOARD SHEETS and issued on Jan. 22, 1985, to Ward et al. The feeding apparatus disclosed in this patent includes a plurality of feed belts. The belts are brought into contact with the sheet and then actuated to bring the sheet to the feed rolls of the processing equipment. The belts are then moved out of contact with the paperboard sheet before their motion is stopped. The intermittent driving of the belts must be synchronized with the operation of lift bars which move the belts into and out of contact with the paperboard sheet.

A still further example of a paperboard sheet feeder includes a feed table which supports a plurality of feed wheels. The wheels are covered with a polyurethane material. A drive arrangement rotates the wheels to feed sheets. A low friction sliding grid is raised as the sheet is fed to the nip of the feed rolls. The grid keeps the sheet out of contact with the feed wheels as the sheet is drawn into the processing equipment by the feed rolls.

A need exists for a reliable sheet feeder of reduced complexity and increased reliability and which may be readily added at the feed ends of existing paperboard processing equipment.

SUMMARY OF THE INVENTION

In accordance with the present invention, the aforementioned needs are substantially fulfilled. Essentially, the paperboard sheet feeder in accordance with the present invention includes a support for retaining a stack of paperboard sheets. A roller assembly is mounted on the support. The roller assembly includes a feed roll which is in contact with the lowermost board of the stack. A drive means is provided for rotating the roll in a positive fashion to feed the paperboard sheet into the processing equipment and then for permitting the roll to freewheel as the sheet is engaged by the feed rolls of the processing equipment.

In narrower aspects of the invention, the paperboard sheet feeder includes a magazine for supporting a stack of paperboard sheets and an adjustable gate which defines a slot through which the sheets are fed. A low friction plate is supported on the table between the feed roller assembly and the slot. The drive means includes a driven gear connected to the roller assembly through a one-way clutch. A drive belt in engagement with the gear has ends fixed to a slide block. Reciprocation of the slide block alternately rotates the drive gear which rotates the roller assembly through the one-way clutch. The slide block may be connected to the kicker arm of a paperboard printer or the like.

The paperboard sheet feeder in accordance with the present invention eliminates the fairly complex transmissions, gear drives and cam arrangements heretofore employed. Also, wear is eliminated or substantially reduced since the feed rolls are permitted to freewheel. This substantially eliminates any relative motion between the surface of the rolls and the paperboard sheet.

DETAILED DESCRIPTION OF THE PREFERRED EMBODIMENT

Figure 1:
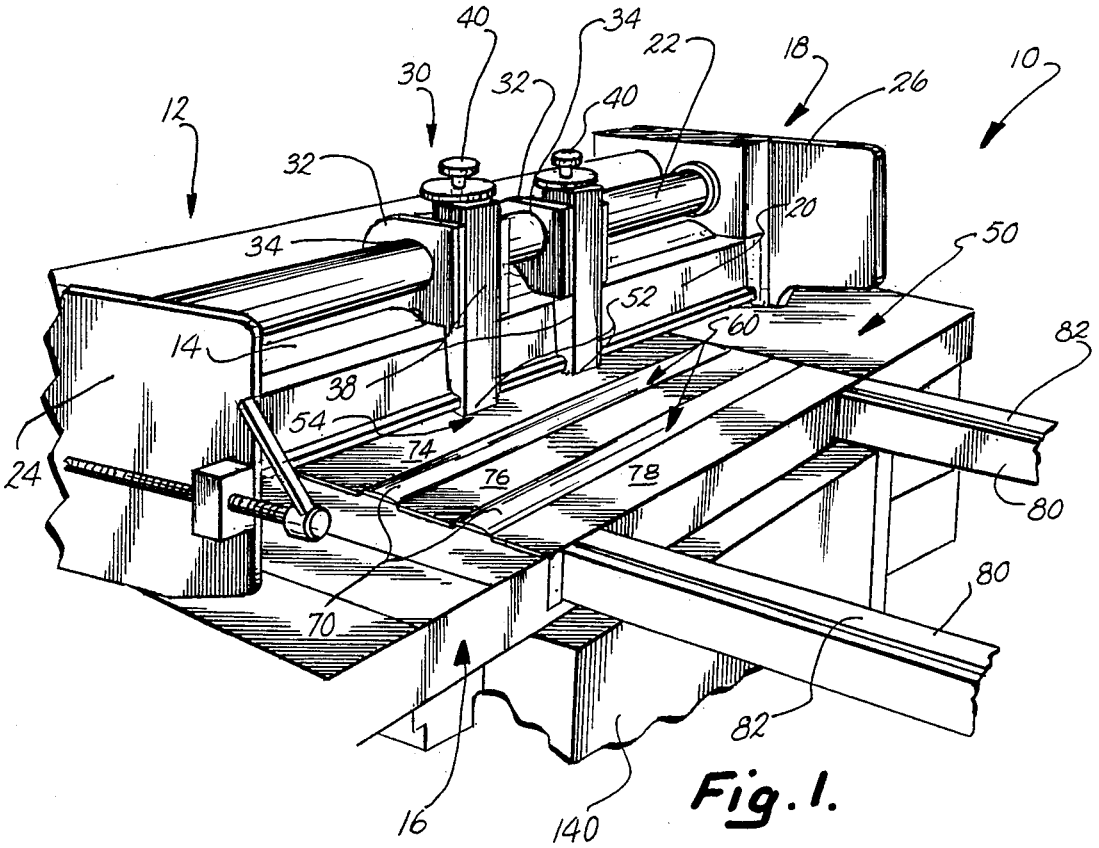
FIG. 1 is a fragmentary, perspective view of a paperboard sheet feeder in accordance with the present invention positioned at the feed end of a paperboard printer.

A preferred embodiment of a paperboard sheet feeder in accordance with the present invention is illustrated in FIG. 1 and generally designated by the numeral 10. Sheet feeder 10 is shown attached to the feed end of a conventional paperboard sheet printer generally designated 12. Printer 12 includes feed rolls 14.

Feeder 10 includes a frame 16. Frame 16 supports a magazine 18. Magazine 18 includes a lower cross member 20, an upper cross member 22 and side plates 24, 26. Side plates 24, 26 are adjustable towards and away from each other on the upper cross member. Also supported on the upper cross member are a pair of adjustable gates 30. Each gate includes a support bracket 32. Brackets 32 define apertures 34 through which the upper cross member extends. Supported on the brackets are vertically adjustable gate blocks 38. The gate blocks 38 are adjustable by threaded members 40.

Mounted on frame 16 is a support or horizontal surface 50. The lower ends 52 of gates 30 define a feed slot 54 in conjunction with horizontal support surface 50 of feeder 10.

Figure 2:
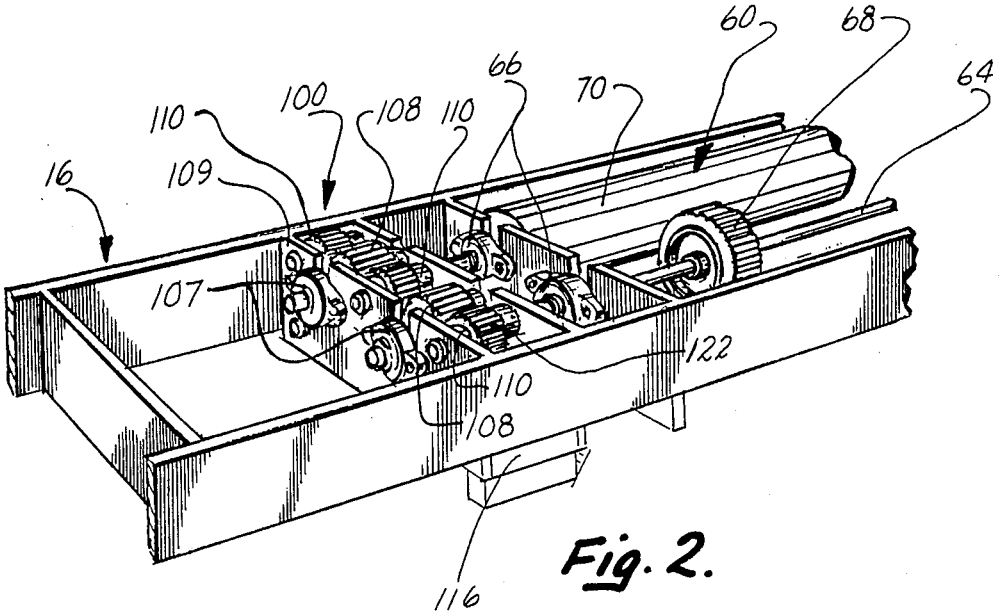
FIG. 2 is a fragmentary, perspective view of a portion of the sheet feeder showing the drive and a portion of feed roller assemblies.

In the preferred embodiment, as illustrated in FIGS. 1 and 2, feeder 10 includes a pair of feed roller assemblies 60. Each roller assembly 60 extends transversely of the frame 16 in spaced, parallel relationship and between the side plates of the magazine subassembly. Each roller assembly 60 includes an elongated shaft 64. Shaft 64 is supported on frame 16 by bearing assemblies 66. Non-rotatably mounted on each shaft 64 are a pair of spaced hubs 68. An elongated roller cylinder or roll 70 is supported on the hubs 68 on the shaft 64. Each roller cylinder 70 is fabricated from a high friction material, such as polyurethane.

Supported on feeder 10 are a plurality of low friction support plates 74, 76 and 78. The plates are fabricated from aluminum or a self-lubricating material, such as nylon. Plate 74 extends transversely of feeder 10 and into slot 54 defined by gates 30. Plate 76 extends between and overlies roller cylinders 70 of assemblies 60. Plate 78 is positioned downstream of the rearmost roller assembly 60. As shown in FIG. 1, a pair of arms 80 are cantilevered outwardly from the rear edge of frame 16. Low friction material plates 82 are secured to the upper surfaces of the arms 80.

In use, a stack of paperboard sheets is positioned within the magazine. The sheets rest on the low friction plates 74, 76, 78 and 82. The feed roller assemblies 60 contact the undersurface of the lowermost sheet in the stack. In order to feed a paperboard sheet through the feed slot and into the processing equipment, roller cylinders 70 are driven.

Figure 3:
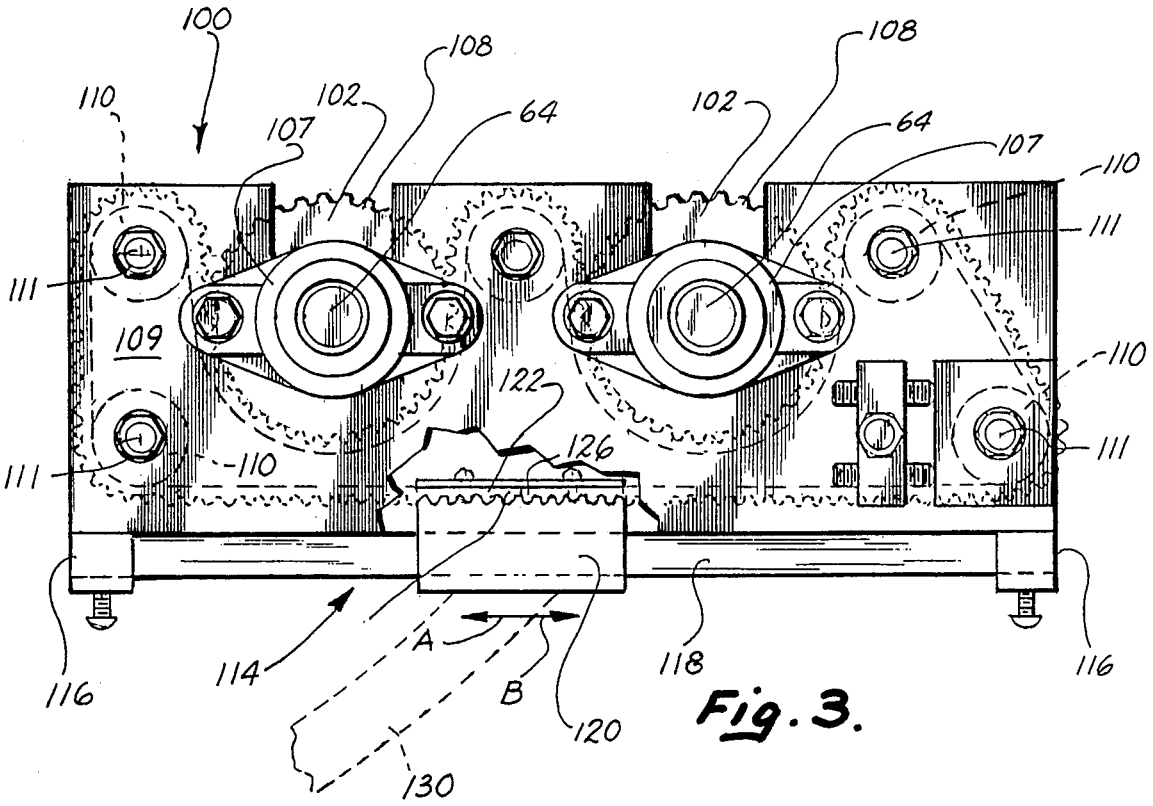
FIG. 3 is a side elevational view of the drive mechanism.

A drive means for rotating the roller cylinders is supported on frame 16 and generally designated by the numeral 100. As seen in FIGS. 2 and 3, conventional one-way rotary clutches 102 are secured to ends 104 of roller shafts 64. Ends 104 are received by bearings 107 secured to a side plate 109. When viewed in FIG. 3, rotation of the shafts 64 in a counterclockwise direction drives the rollers 70 through the clutches. Secured to one-way clutches 102 are drive gears 108. A plurality of idler rollers 110 are supported on frame 16 by axles 111.

Supported below drive gears 108 is a carriage and guide subassembly 114. Assembly 114 includes end plates 116. A pair of guide rods 118 extend between the plates 116. A slide block 120 is slidably mounted on guide rods 118.

An elongated, flexible drive transmission means in the form of a gear belt 122 converts reciprocating motion of block 120 to alternating rotary motion of the drive gears 108. Belt 122 includes ends 124, 126 which are secured to block 120. Belt 122 extends over the idler rollers 110 and is held in contact with the drive gears 108.

In the preferred form, slide block 120 is connected to a kicker arm 130 of equipment 12, as schematically shown in FIG. 3. Kicker arm 130 is reciprocated by the processing equipment 12 in a conventional fashion. As slide block 120 is moved in the direction of arrow A in FIG. 3, gear belt 122 rotates the drive gears 108 in a counterclockwise direction. The drive gears through the one-way clutches rotate the roller cylinders 70 in a positive manner to feed a paperboard sheet through the slot defined by the gate subassemblies and into the nip defined by the feed rollers of the processing equipment 12. When slide block 120 is moved in the direction of arrow B in FIG. 3, gears 108 are rotated in a clockwise direction. No force is transmitted to the roller cylinders 70. The roller assemblies are permitted to freewheel and continue to rotate in a counterclockwise direction.

Figure 4:
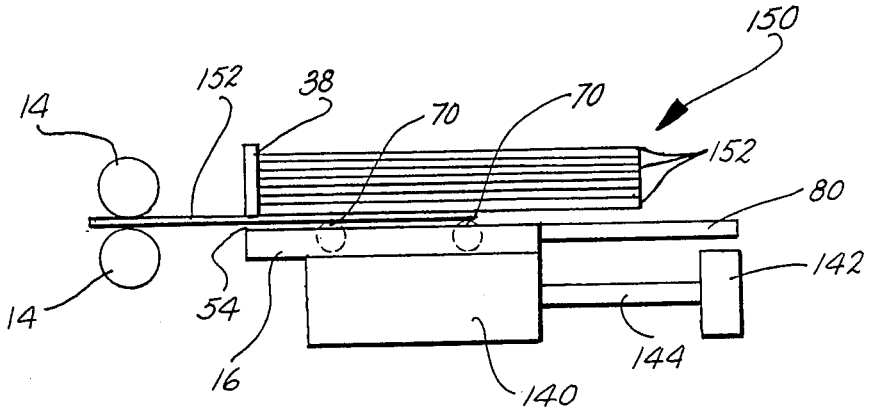
FIG. 4 is a schematic, side elevational view showing the operation of the feeder.

As illustrated in FIGS. 1 and 4, sheet feeder 10 includes a plenum 140 mounted on frame 16 beneath roller assemblies 60. Plenum 140 is connected to a blower 142 through duct work 144. Blower 142 evacuates air from plenum 140. The blower, therefore, creates a suction within the plenum which draws the lowermost sheet of a stack of sheets into contact with the high friction outer surface of rollers 70.

OPERATION

In operation, a stack 150 of paperboard sheets 152 is positioned within the magazine subassembly (FIG. 4). Gate blocks 38 are adjusted vertically to define the appropriate slot 54 which is dependent upon the thickness of the individual sheets. Blower 142 is activated and the lowermost sheet of the stack is drawn into contact with roller assemblies 60. Slide block 120 is moved in the direction of arrow A, as shown in FIG. 3. Roller cylinders 70 are rotated and the lead edge of the lowermost sheet of the stack is passed through the feed slot and into the nip defined by feed rollers 14 of processing equipment 12. At the completion of the stroke, block 120 is then moved in the opposite direction as the lowermost sheet is being drawn into the processing equipment. While block 120 is shifted in the direction of arrow B, roller cylinders 70 are permitted to freewheel. This eliminates relative movement between the roller assemblies and the paperboard sheet. As a result, wear of the feed roller cylinders is minimized or eliminated. Also, scuffing or other possible damage to the sheet is minimized or eliminated. Plates 74, 76 and 78 provide a low friction support surface. This permits the sheet to be drawn easily into the processing equipment. After the first sheet is fed, block 120 is then again shifted in the direction of arrow A to start another feed cycle.

The feed table including the drive arrangement in accordance with the present invention is of substantially reduced complexity from that heretofore available. The slide block and gear belt arrangement reliably drive rollers 70. Complicated gear drive, cam and indexing transmissions are eliminated. Wear is reduced. Downtime for maintenance is also reduced.

In view of the foregoing description, those of ordinary skill in the art will undoubtedly envision various modifications which would not depart from the inventive concepts disclosed. For example, a belt pulley arrangement could be substituted for the gear belt structure included in the preferred embodiment. The gear belt arrangement is preferred, however, due to the elimination of slippage and the positive drive provided. Therefore, the above description should be considered as only that of the preferred embodiment. The true scope and spirit of the present invention may be determined from the appended claims.

The embodiments of the invention in which an exclusive property or privilege is claimed are defined as follows:

1. A paperboard sheet feeder, comprising:
a support for a stack of paperboard sheets;
a roller on said support;
bearing means engaging said roller for rotatably supporting said roller on said support;
drive means for rotating said roller, said drive means including:
a drive gear;
clutch means connecting said drive gear to said roller for rotating said roller when said drive gear is rotated in one direction and for allowing said roller to freewheel when said drive gear is rotated in an opposite direction;

a drive belt having a surface engaging said drive gear;

a guide; and a slide block slidably mounted on said guide, said drive belt being connected to said block so that said drive gear is driven in said one direction and then in said opposite direction as said slide block reciprocates on said guide and said roller is driven in a positive manner when said drive gear is rotated in said one direction and said roller freewheels when said drive gear is driven in said opposite direction.

2. A paperboard sheet feeder as defined by claim 1 wherein said roller comprises:

a shaft;

a pair of hubs on said shaft; and an elongated roller cylinder surrounded by said hubs.

3. A paperboard sheet feeder as defined by claim 2 further including:

gate means on said support for defining a feed slot through which a paperboard sheet is fed by said roller.

4. A paperboard sheet feeder as defined by claim 3 further including:

a plenum mounted on said support beneath said roller; and means connected to said plenum for withdrawing air from said plenum to pull a sheet into contact with said roller.

5. A paperboard sheet feeder as defined by claim 4 wherein said roller cylinder is fabricated from urethane.

6. A paperboard sheet feeder as defined by claim 5 wherein said drive belt includes a plurality of teeth which engage said drive gear.

7. A paperboard sheet feeder as defined by claim 3 further including an elongated plate on said support between said gate and said roller.

8. A paperboard sheet feeder as defined by claim 7 further including:

another roller rotatably supported on said support and another drive gear engaged by said drive belt for rotating said another roller in one direction.

9. A paperboard sheet feeder as defined by claim 1 wherein said drive belt includes a plurality of teeth which engage said drive gear.

10. A paperboard sheet feeder as defined by claim 1 further including:

another roller rotatably supported on said support and another drive gear engaged by said drive belt for rotating said another roller in one direction.

11. A lead edge paperboard sheet feeder for feeding individual sheets from a stack of sheets to paperboard processing equipment such as printers, cutters, slotters and the like, said sheet feeder comprising:

a frame;

a paperboard sheet magazine on said frame, said magazine including a horizontal surface, a gate defining a slot with said horizontal surface and side members, said magazine dimensioned to retain a stack of sheets between said side members and in contact with said gate;

roller means on said frame and extending between said side members for contacting a lowermost sheet of a stack and driving said lowermost sheet through said slot; and drive means connected to said roller means for rotating said roller means in a positive fashion in one direction to feed said lowermost sheet through said slot and for permitting said roller means to freewheel in said one direction after said sheet is fed through said slot and engaged by the paperboard processing equipment, said drive means including:

a shaft nonrotatably connected to said roller means;

a one-way clutch on said shaft;

a driven member mounted on said one-way clutch;

a reciprocating slide on said frame;

means connected to said slide for reciprocating said slide towards and away from said slot; and an elongated flexible drive transmission means connected to said slide and engaging said driven member for converting reciprocating motion of said slide to alternating rotary motion of said driven member, said shaft and said roller means being driven in a positive fashion when said driven member is rotated in one direction and said shaft and said roller means freewheeling when said driven member is rotated in another direction.

12. A lead edge paperboard sheet feeder as defined by claim 11 wherein said driven member is a gear and said drive transmission means is an elongated drive belt having teeth engaging said gear and ends secured to said slide.

13. A lead edge paperboard sheet feeder as defined by claim 12 wherein said drive means further includes:

a plurality of idler rollers rotatably supported on said frame adjacent said gear, said drive belt extending over said idler gears and under said gear.

14. A lead edge paperboard sheet feeder as defined by claim 13 wherein said roller means comprises:

an elongated roller cylinder;

a pair of hubs secured to said shaft and supporting said cylinder on said shaft; and bearing means secured to said frame and rotatably supporting said shaft.

15. A lead edge paperboard sheet feeder as defined by claim 14 further including a low friction, elongated plate positioned between said roller means and said slot on said frame.

16. A lead edge paperboard sheet feeder as defined by claim 15 further including:

a plenum on said frame and below said roller means; and a blower connected to said plenum for withdrawing air from said plenum and pulling the lowermost sheet of the stack into contact with said roller means.

17. A lead edge paperboard sheet feeder as defined by claim 16 wherein said roller cylinder is fabricated from a high friction material.

18. A lead edge paperboard sheet feeder as defined by claim 17 wherein said high friction material is a urethane.

19. A lead edge paperboard sheet feeder as defined by claim 18 wherein said low friction elongated plate is fabricated from nylon.

20. A lead edge paperboard sheet feeder as defined by claim 11 further including a low friction, elongated plate positioned between said roller means and said slot on said frame.

* * * * *